US006981677B1

(12) United States Patent
Tjeerdsma

(10) Patent No.: US 6,981,677 B1
(45) Date of Patent: Jan. 3, 2006

(54) TOOL STORAGE DEVICE

(76) Inventor: Wayne Tjeerdsma, 607 W. 2nd Ave., Avon, SD (US) 57315

( * ) Notice: Subject to any disclaimer, the term of this patent is extended or adjusted under 35 U.S.C. 154(b) by 107 days.

(21) Appl. No.: 10/625,619

(22) Filed: Jul. 23, 2003

(51) Int. Cl.
*A47G 1/10* (2006.01)

(52) U.S. Cl. ..... 248/316.5; 248/316.1; 211/70.6; 211/89.01

(58) Field of Classification Search .. 248/316.1–316.3, 248/316.5, 316.7, 451, 452, 62, 63, 71, 74.1; 211/706.6, 89.01
See application file for complete search history.

(56) References Cited

U.S. PATENT DOCUMENTS 1,320,275 A * 10/1919 Roach ..... 222/103
1,691,155 A * 11/1928 Howell ..... 248/316.5
1,919,767 A * 7/1933 Bohlman ..... 248/316.1
3,219,363 A * 11/1965 Adrian et al. ..... 280/851
3,297,288 A * 1/1967 Cardoza ..... 248/108
4,735,393 A * 4/1988 Albee, Jr. ..... 248/452
4,899,966 A * 2/1990 Antos et al. ..... 248/74.4
5,197,705 A * 3/1993 Baskas ..... 248/316.7
5,236,760 A * 8/1993 Jinn ..... 428/100
5,312,082 A * 5/1994 Chang ..... 248/452
6,481,585 B1 * 11/2002 Cloughton ..... 211/89.01

* cited by examiner

*Primary Examiner*—Korie Chan
(74) *Attorney, Agent, or Firm*—Jeffrey A. Proehl

(57) ABSTRACT

A tool storage device for selectively retaining a tool against a structure. The tool storage device includes a mounting assembly, a first jaw assembly, and a second jaw assembly. The mounting assembly is for selectively coupling the system to a vertical surface of a structure. The first jaw assembly is operationally coupled to the mounting assembly, and is designed for abutting a first side of the handle of the tool being retained. The second jaw assembly is pivotally coupled to the mounting assembly, and is designed for abutting a second side of the handle of the tool being retained. The handle is selectively retained between the first jaw assembly and the second jaw assembly.

28 Claims, 7 Drawing Sheets

TOOL STORAGE DEVICE

BACKGROUND OF THE INVENTION

1. Field of the Invention

The present invention relates to tool holders and more particularly pertains to a new tool storage device for selectively retaining a tool against a structure.

2. Description of the Prior Art

The use of tool holders is known in the prior art. More specifically, tool holders heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose a new tool storage device. The inventive device includes a mounting assembly, a first jaw assembly, and a second jaw assembly. The mounting assembly is for selectively coupling the system to a vertical surface of a structure. The first jaw assembly is operationally coupled to the mounting assembly, and is designed for abutting a first side of the handle of the tool being retained. The second jaw assembly is pivotally coupled to the mounting assembly, and is designed for abutting a second side of the handle of the tool being retained. The handle is selectively retained between the first jaw assembly and the second jaw assembly.

In these respects, the tool storage device according to the present invention substantially departs from the conventional concepts and designs of the prior art, and in so doing provides an apparatus primarily developed for the purpose of selectively retaining a tool against a structure.

SUMMARY OF THE INVENTION

In view of the foregoing disadvantages inherent in the known types of tool holders now present in the prior art, the present invention provides a new tool storage device construction wherein the same can be utilized for selectively retaining a tool against a structure.

The general purpose of the present invention, which will be described subsequently in greater detail, is to provide a new tool storage device apparatus and method which has many of the advantages of the tool holders mentioned heretofore and many novel features that result in a new tool storage device which is not anticipated, rendered obvious, suggested, or even implied by any of the prior art tool holders, either alone or in any combination thereof.

To attain this, the present invention generally comprises a mounting assembly, a first jaw assembly, and a second jaw assembly. The mounting assembly is for selectively coupling the system to a vertical surface of a structure. The first jaw assembly is operationally coupled to the mounting assembly, and is designed for abutting a first side of the handle of the tool being retained. The second jaw assembly is pivotally coupled to the mounting assembly, and is designed for abutting a second side of the handle of the tool being retained. The handle is selectively retained between the first jaw assembly and the second jaw assembly.

Throughout this specification the tool holding system is described in the context of retaining a handle of a tool, for the sake of simplicity in explanation of the operation of the device. However, the present invention anticipates being used in conjunction with a wide range of tools and in multiple configurations. Therefore it is possible, and indeed likely that the present invention will be used to retain tools without "handles" by retaining the bodies, housings, or other elements of the tool. Additionally, the present device can be used with coiled tools such as extension cords, lariats, cables, hoses, or other such tools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool storage device apparatus and method which has many of the advantages of the tool holders mentioned heretofore and many novel features that result in a new tool storage device which is not anticipated, rendered obvious, suggested, or even implied by any of the prior art tool holders, either alone or in any combination thereof.

It is another object of the present invention to provide a new tool storage device which may be easily and efficiently manufactured and marketed.

It is a further object of the present invention to provide a new tool storage device which is of a durable and reliable construction.

An even further object of the present invention is to provide a new tool storage device which is susceptible of a low cost of manufacture with regard to both materials and labor, and which accordingly is then susceptible of low prices of sale to the consuming public, thereby making such tool storage device economically available to the buying public.

Still yet another object of the present invention is to provide a new tool storage device which provides in the apparatuses and methods of the prior art some of the advantages thereof, while simultaneously overcoming some of the disadvantages normally associated therewith.

Still another object of the present invention is to provide a new tool storage device for selectively retaining a tool against a structure.

Yet another object of the present invention is to provide a new tool storage device which includes a mounting assembly, a first jaw assembly, and a second jaw assembly. The mounting assembly is for selectively coupling the system to a vertical surface of a structure. The first jaw assembly is operationally coupled to the mounting assembly, and is designed for abutting a first side of the handle of the tool being retained. The second jaw assembly is pivotally coupled to the mounting assembly, and is designed for abutting a second side of the handle of the tool being retained. The handle is selectively retained between the first jaw assembly and the second jaw assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
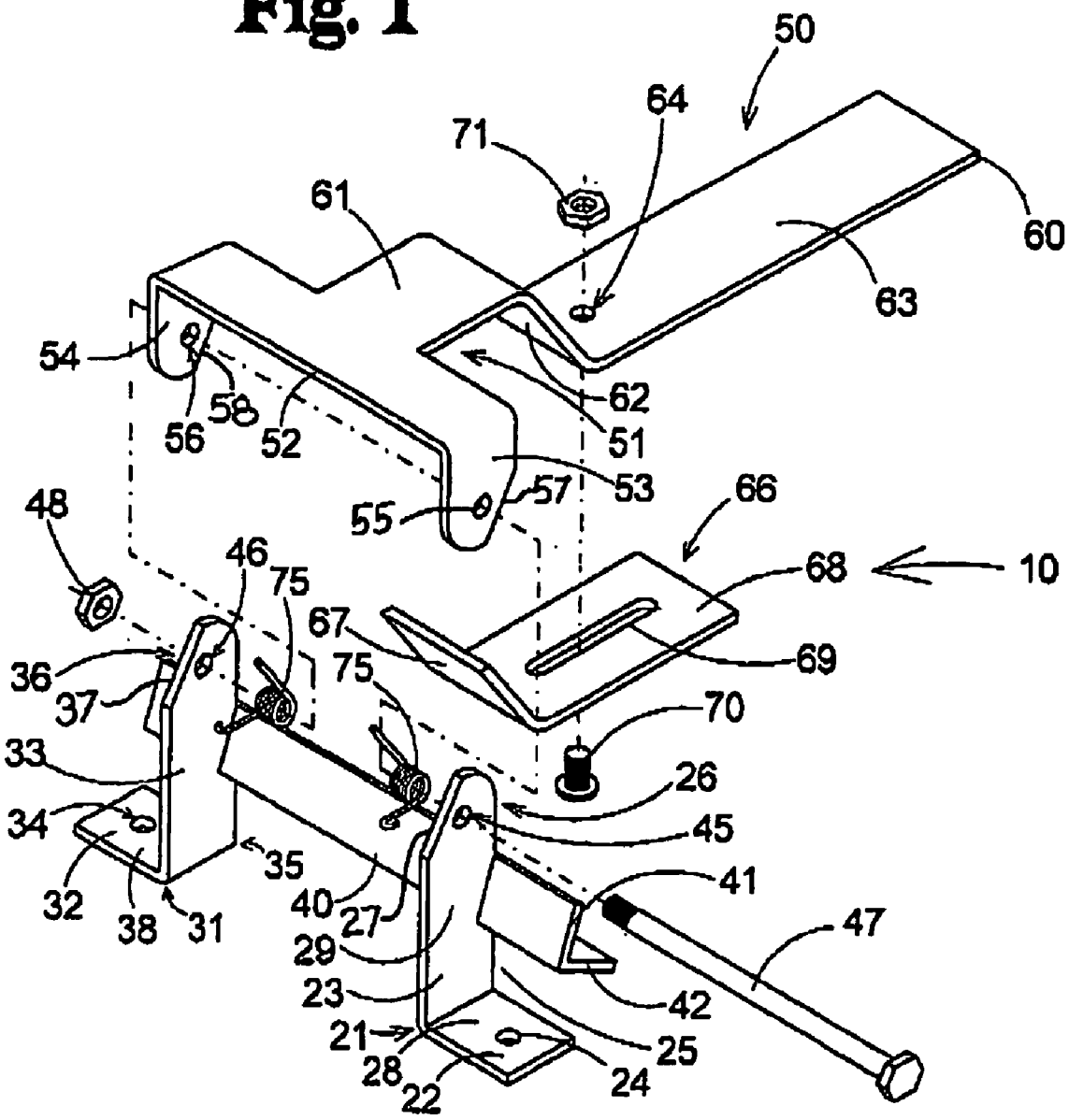
FIG. 1 is a schematic perspective exploded view of a new tool storage device according to the present invention.
Figure 2:
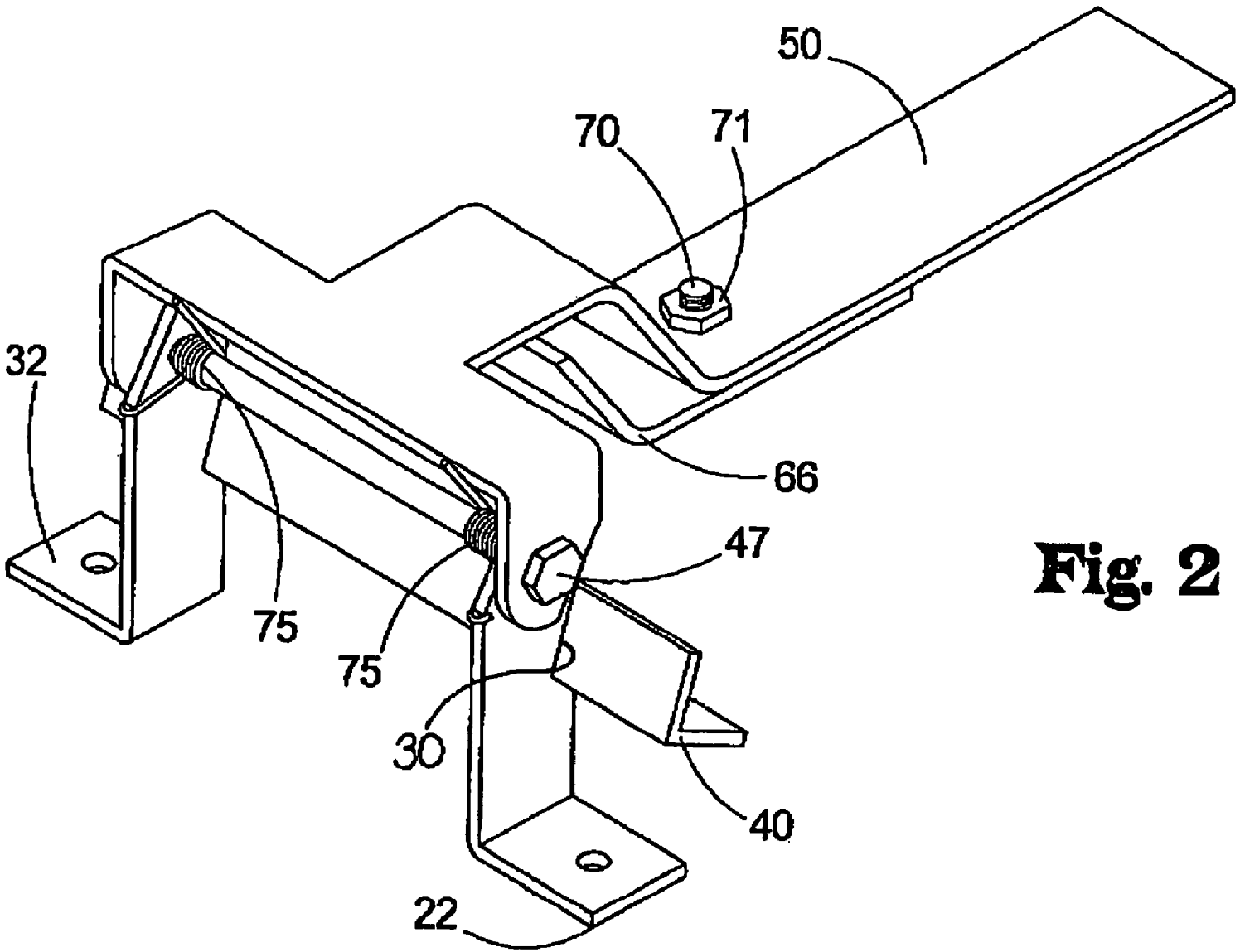
FIG. 2 is a schematic perspective rear view of the present invention.
Figure 3:
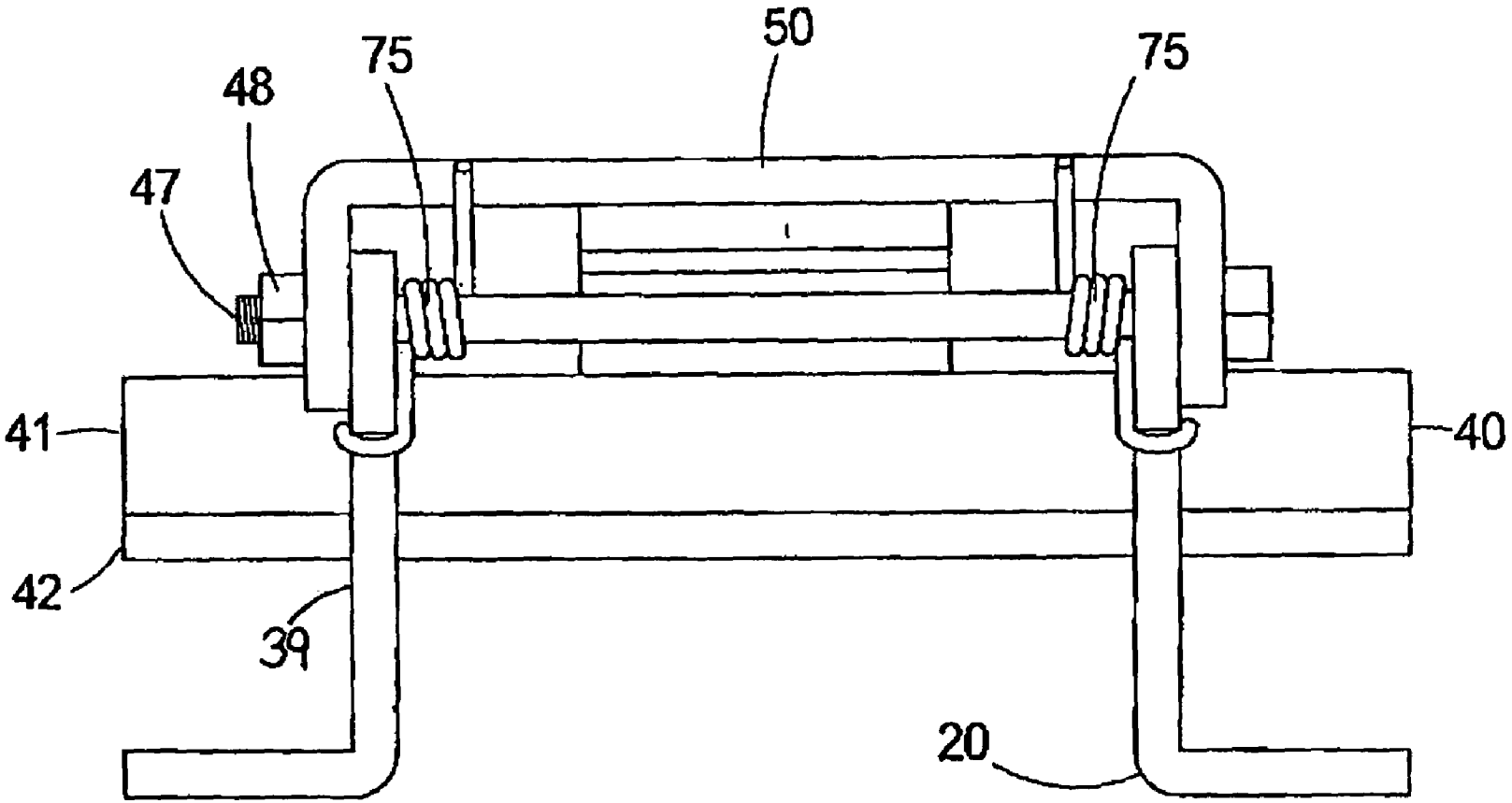
FIG. 3 is a schematic rear view of the present invention.
Figure 4:
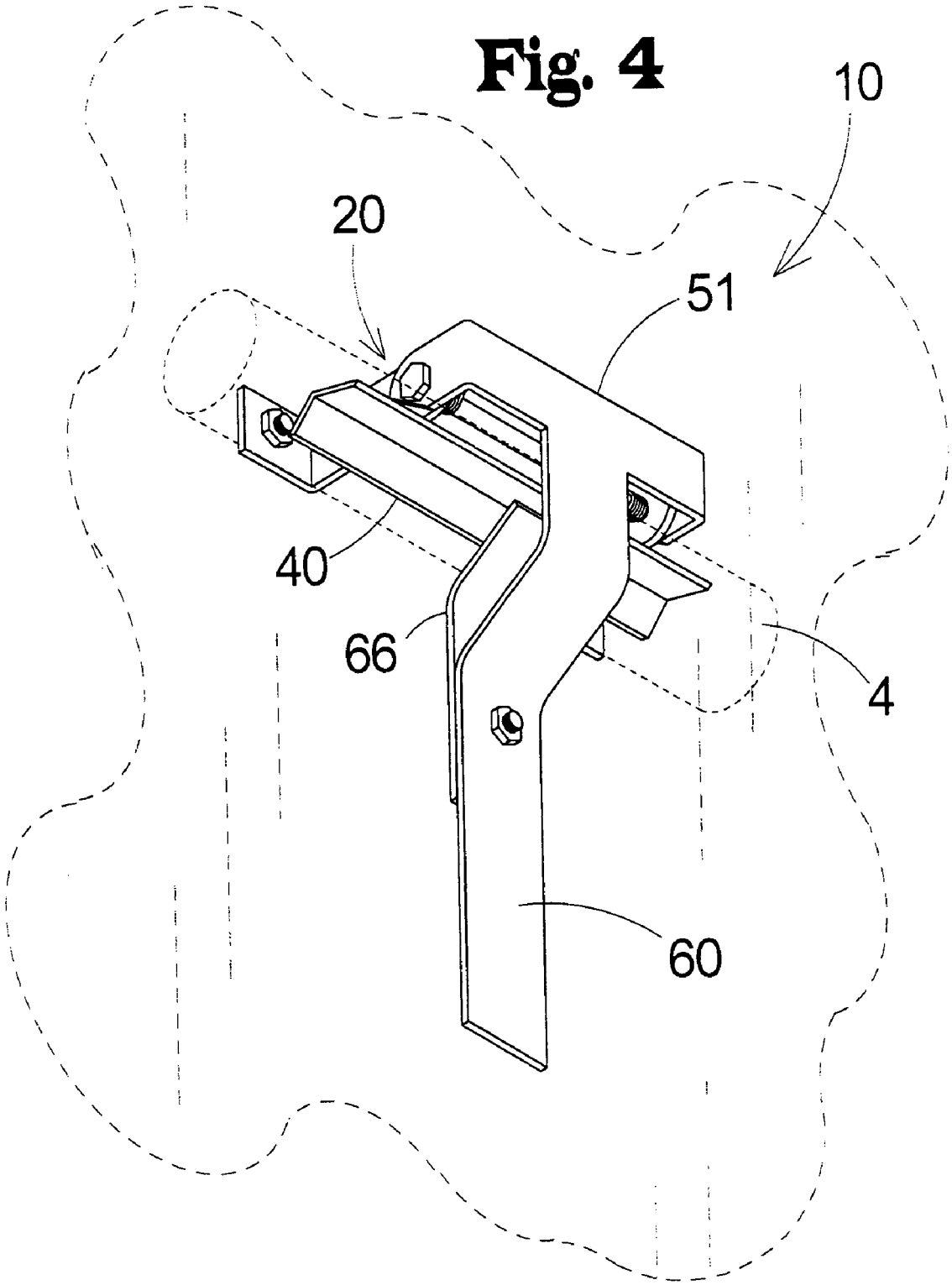
FIG. 4 is a schematic perspective front view of the present invention.

With reference now to the drawings, and in particular to FIGS. 1 through 7 thereof, a new tool storage device embodying the principles and concepts of the present invention and generally designated by the reference numeral 10 will be described.

As best illustrated in FIGS. 1 through 7, the tool storage device 10 generally comprises a mounting assembly 20, a first jaw assembly 40, and a second jaw assembly 50.

The mounting assembly 20 is for selectively coupling the system 10 to a vertical surface of a structure 6. The first jaw assembly is operationally coupled to the mounting assembly 20, and is designed for abutting a first side of the handle 4 of the tool 2 being retained. The second jaw 50 assembly is pivotally coupled to the mounting assembly 20, and is designed for abutting a second side of the handle 4 of the tool 2 being retained. The handle 4 is selectively retained between the first jaw assembly 40 and the second jaw assembly 50.

In an embodiment the mounting assembly 20 further comprises a first mounting member 21 and a second mounting member 31. The first mounting member 21 includes a first flange portion 22 and a first horizontal support portion 23. The first flange portion 22 is for abutting the vertical surface of the structure 6. The first horizontal support portion 23 is coupled to the first flange portion 22. The first flange portion 22 includes a top surface 28 defining a plane. The first horizontal support portion 23 includes a first surface 29 defining a first vertical plane. The first support horizontal portion 23 is preferably positioned such that the first vertical plane is substantially perpendicular to the plane formed by the top surface 28. Similarly, the second mounting member 31 also includes a second flange portion 32 and a second horizontal support portion 33. The second flange portion 32 is for abutting the vertical surface of the structure 6. The second horizontal support portion 33 is coupled to the second flange portion 32. The second flange portion 32 includes a second top surface 38 defining a second plane. The second horizontal support portion 33 includes a second surface 39 defining a second vertical plane. The second horizontal support portion 33 is preferably positioned such that the second vertical plane is substantially perpendicular to the second plane formed by the second top surface 38.

In a further embodiment, the first flange portion 22 includes an aperture 24 extending therethrough, which facilitates coupling the first flange portion 22 to the surface of the structure 6. Similarly, the second flange portion 32 includes a second aperture 34 extending therethrough. The second aperture 34 facilitates coupling the second flange portion 32 to the surface of the structure 6.

In still a further embodiment, the first horizontal support portion 23 includes a proximal end 25 and a distal end 26. The proximal end 25 is adjacent to the first flange portion 22, and the distal end 26 is adjacent to the first jaw assembly 40. The first horizontal support portion 23 includes a taper 27 extending from a medial portion towards the distal end 26. The distal end 26 includes a width less than a width associated with the medial portion. The taper 27 permits pivoting of the second jaw assembly 50 with respect to the mounting assembly 20. Similarly, the second horizontal support portion 33 also includes a proximal end 35 and a distal end 36. The proximal end 35 is adjacent to the second flange portion 32. The distal end 36 is adjacent to the first jaw assembly 40. The second horizontal support portion 33 includes a taper 37 extending from a medial portion towards the distal end 36. The distal end 36 includes a width less than a width associated with the medial portion. The taper 37 permits pivoting of the second jaw assembly 50 with respect to the mounting assembly 20.

In yet a further embodiment the first jaw assembly 40 further comprises a horizontal portion 41 and a vertical portion 42. The horizontal portion 41 is operationally coupled to the mounting assembly 20. The vertical portion 42 is operationally coupled to the horizontal portion 41. The horizontal 41 and vertical portions 42 are for abutting the handle 4 to the tool 2 being retained.

In an embodiment the mounting assembly 20 has an angular notch 30 for receiving the horizontal portion 41 and the vertical portion 42 of the first jaw assembly 40. The angular notch 30 increases a surface area of contact between the mounting assembly 20 and the first jaw assembly 40 to strengthen a union of the mounting assembly 20 and the first jaw assembly 40.

In a further embodiment the angular notch 30 is positioned in the mounting assembly 20 such that a first portion of the angular notch 30 has an axis oriented approximately fifteen degrees from vertical, the angular notch 30 also has a second portion positioned at a right angle to the first portion of the angular notch 30.

In even still a further embodiment the second jaw assembly 50 further comprises a coupling portion 51, a lever portion 60, a width adjustment portion 66, and a retaining portion. The coupling portion 51 is pivotally couplable to the mounting assembly 20. The lever portion 60 is coupled to the coupling portion 51 and extends downwardly from the coupling portion 51. The lever portion 60 provides a clamping force for retaining the handle 4 of the tool 2. The width adjustment portion 66 is slidably coupled to the lever portion 60 and facilitates adjustment of the second jaw assembly 50 to accommodate a diameter of the handle 4 of the tool 2 being retained. The retaining assembly is for slideably coupling the width adjustment portion 66 to the lever portion 60.

In an embodiment the coupling portion 51 further comprises a horizontal member 52, a first tab portion 53, and a second tab portion 54. The horizontal member 52 extends between the first support portion 23 and the second support portion 33. The first tab portion 53 extends rearwardly from the horizontal member 52 adjacent to the first support portion 23. The first tab portion 53 facilitates pivotal coupling of the second jaw assembly 50 to the mounting assembly 20. Similarly, the second tab portion 54 also extends rearwardly from the horizontal member 52 adjacent to the second support portion 33. The second tab portion 54 facilitates pivotal coupling of the second jaw assembly 50 to the mounting assembly 20. A first coupling hole 45 may extend through the first support portion 23. A second coupling hole 55 may extending extend through the first tab portion 53. The second coupling hole 62 is aligned with the first coupling hole 45. A third coupling hole 46 may extend through the second support portion 33. A fourth coupling hole 56 may extend through the second tab portion 54. The fourth coupling hole 54 is aligned with the third coupling hole 46. Preferably, a single bolt 47 extends through the first 45, second 55, third 46 and fourth coupling holes 56. The bolt 47 is secured with an associated nut 48.

In an embodiment the second hole 55 is offset from a center of the first tab portion 53 and the fourth hole 56 is offset from a center of the second tab portion 54.

In an embodiment a first coupling means and a second coupling means further comprises a single pin 47 extending through the first 45, second 55, third 46, and fourth coupling holes 56. The pin 47 may be secured either by a cotter pin 43, a grip ring 44, or any other suitable device.

In a further embodiment, each one of a pair of biasing members 75 is operationally coupled between the second jaw assembly 50 and the mounting assembly 20. Each one of the pair of biasing members 75 urges the second jaw member 50 towards a closed portion. Thus, the handle 4 of the tool 2 is retained.

Figure 5:
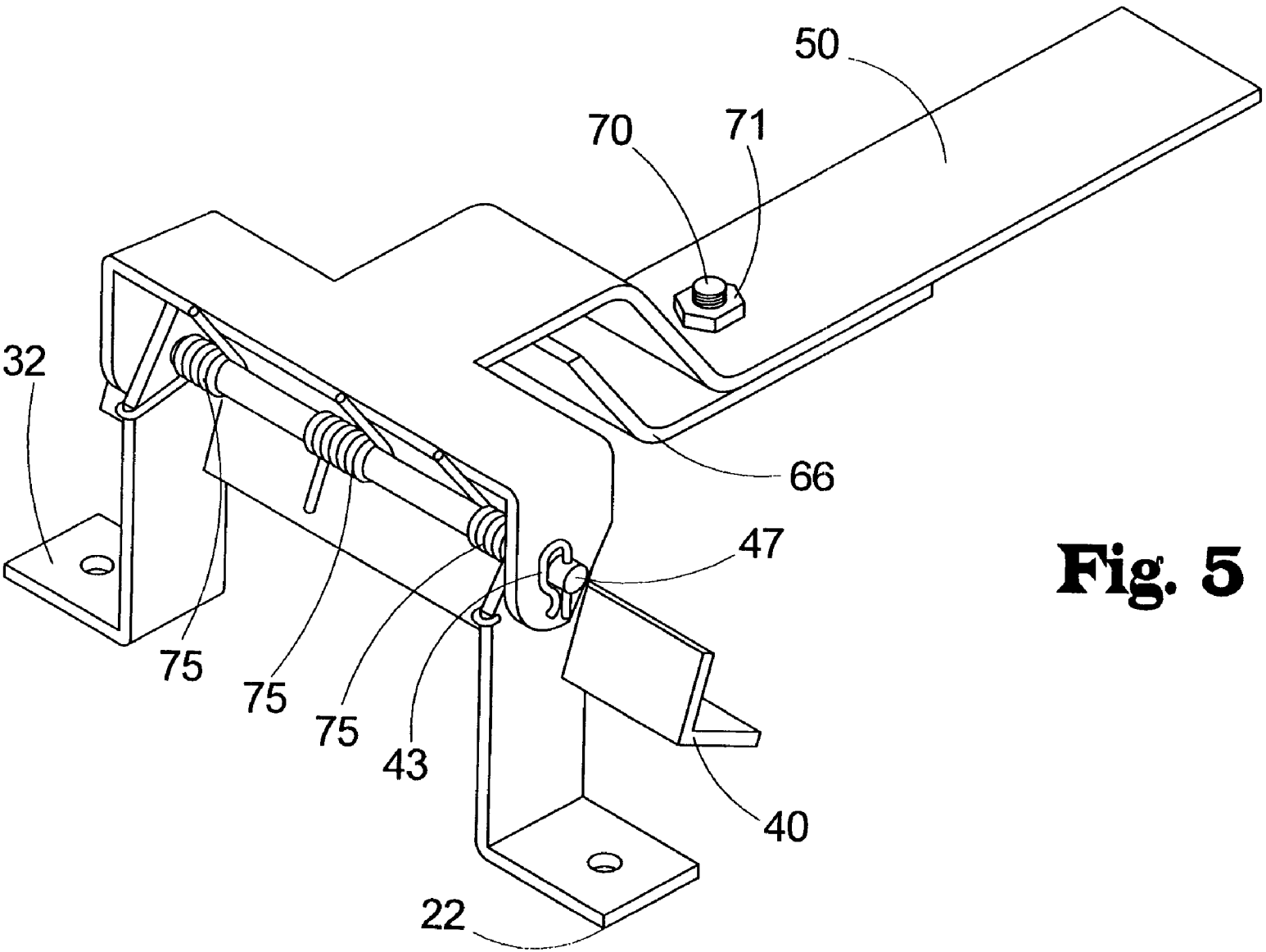
FIG. 5 is a schematic perspective rear view of an embodiment of the present invention.
Figure 6:
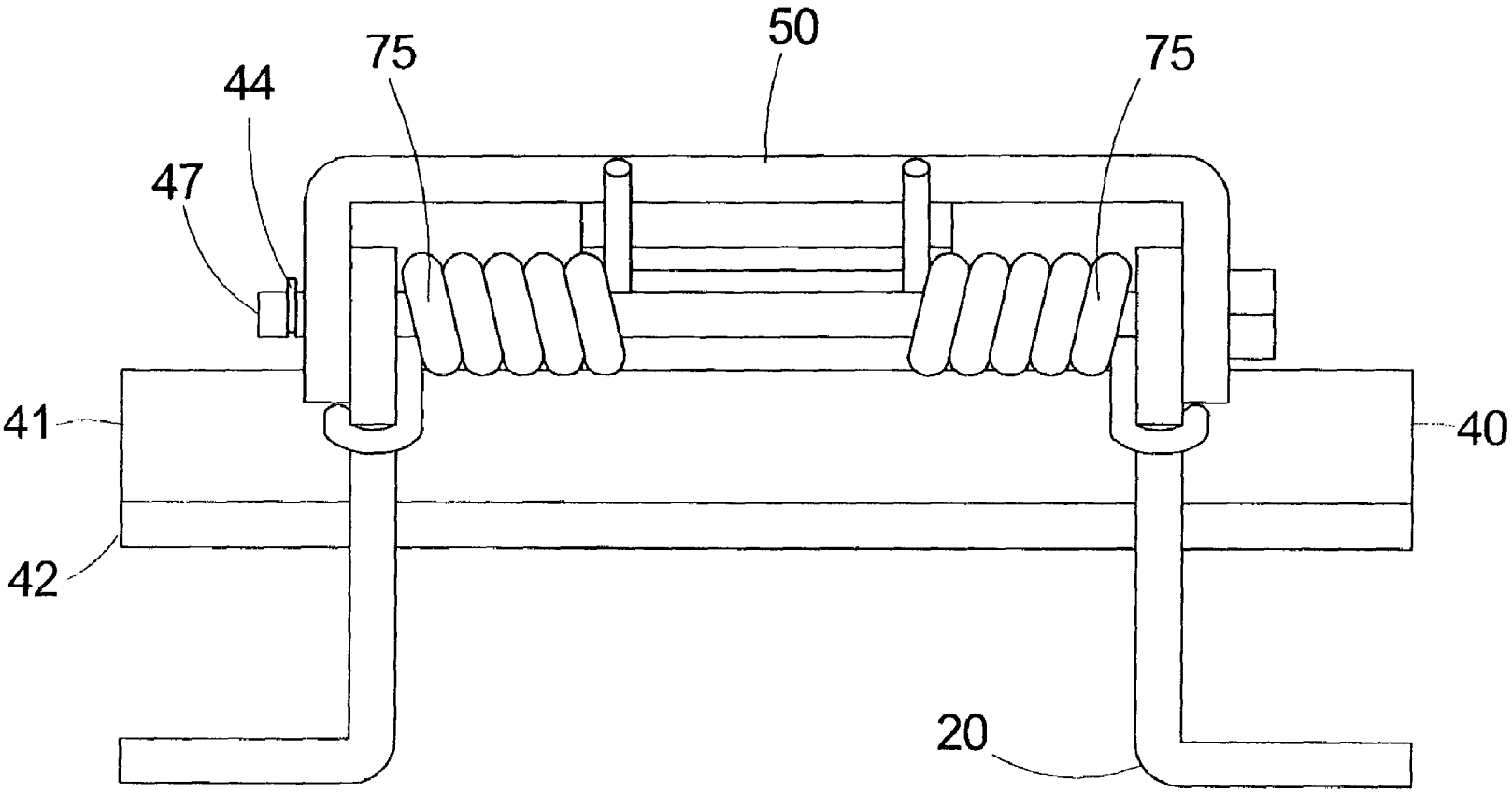
FIG. 6 is a schematic rear view of an embodiment of the present invention.

In the embodiment shown in FIG. 5, a first, second and third biasing member 75 are operationally coupled between the second jaw assembly 50 and the mounting assembly 20. Each one of said first, second, and third biasing members 75 urge the second jaw assembly 50 towards a closed position. Thus, the handle 4 of the tool 2 is retained. Most preferably, the first biasing member is a spring having seven coils and is adjacent to the first horizontal support portion 23; the second biasing member is a spring having seven coils and is adjacent to the second horizontal support portion 33; and the third biasing member is a spring having five coils, and is positioned between the first biasing member and the second biasing member.

In still a further embodiment each one of the first 53 and second tab portions 54 further comprise a tapered edge 57,58 extending adjacent the first jaw assembly 40. The tapered edge 57,58 abut the first jaw assembly 40 when the second jaw assembly 50 is pivoted to a maximum open position. The tapered edge 57,58 functions as a stop for the second jaw assembly 50.

In yet a further embodiment the lever portion 60 further comprises a first extent 61, a second extent 62, and a third extent 63. The first extent 61 is coupled to the coupling portion 51. The first extent 61 extends downwardly from the coupling portion 51. The first extent 61 defines a maximum width between the first jaw assembly 40 and the width adjustment portion 66 of the second jaw assembly 50. The second extent 62 has an angular relationship to the first extent 61, and is coupled to the first extent 61. The third extent 63 extends downwardly from the second extent 62. The third extent 63 abuts the surface of the structure 6 when the second jaw assembly 50 is in a closed portion. The third extent 63 provides a handle to be grasped by the user to facilitate removal of the tool 2 being retained from the system 10.

Figure 7:
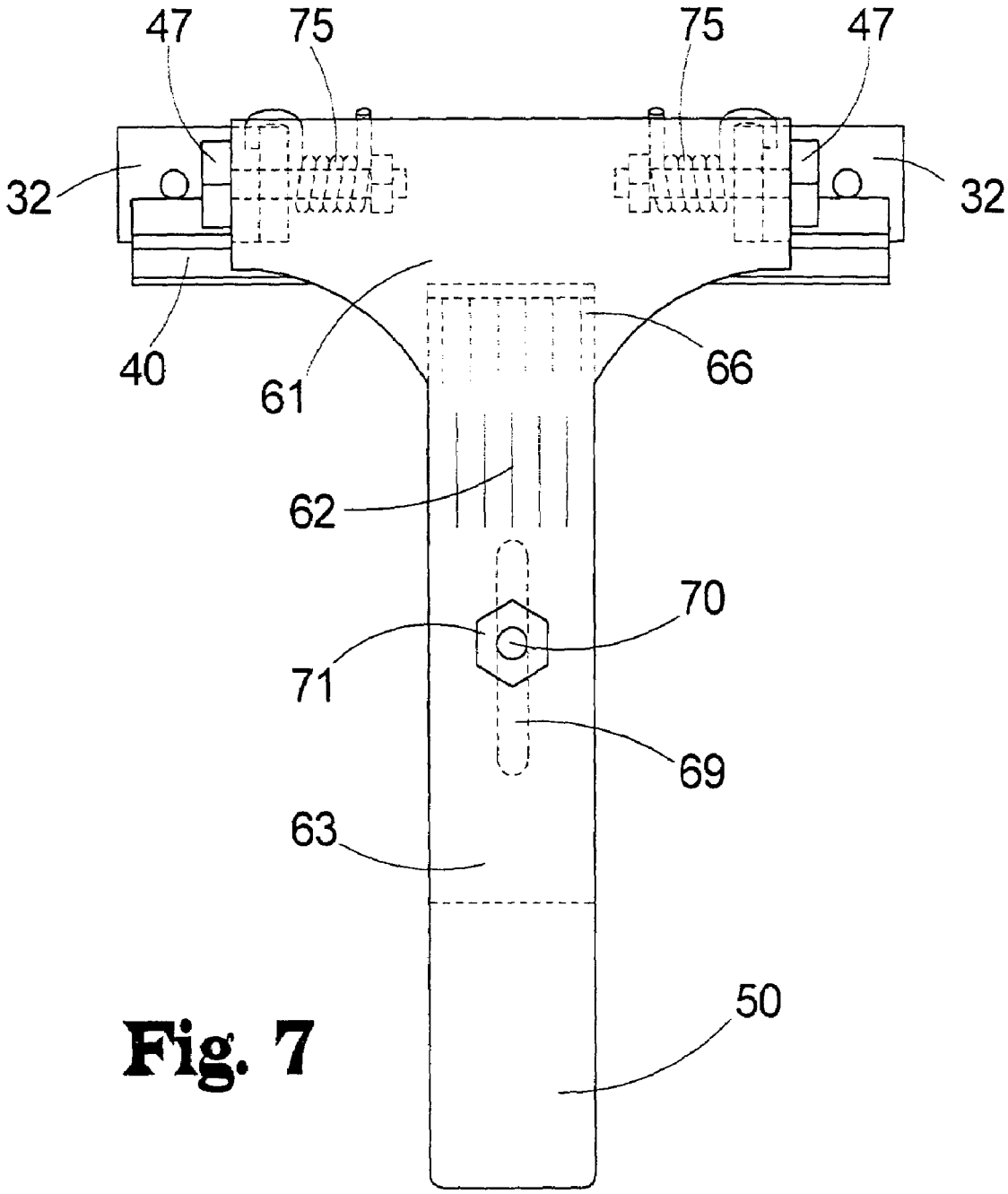
FIG. 7 is a schematic top view of the present invention.

In the embodiment shown in FIG. 7, the first extent 61 tapers inwardly as it extends away from the coupling portion 51 towards the second extent 62. Put differently, the first extent 61 has a first width adjacent to the coupling portion 51, the first extent also has a second width adjacent to the second extent 62, and the first width is greater than the second width.

In still yet a further embodiment the width adjustment portion 66 further comprises a first retaining extent 67 and a second retaining extent 68. The first retaining extent 67 is substantially parallel to the second extent 62 of the lever portion 60. The second retaining extent 68 is substantially parallel to the third extent 63 of the lever portion 60. The second retaining extent 68 is slidable along the third extent 63. Thus, a width of the second jaw assembly 50 is adjustable. A lever aperture 64 extends through the third extent 63 of the lever portion 60; and a slot 69 extends along a longitudinal axis of the second retaining extent 68. A retaining member 70 extends through the slot 69 and the lever aperture 64. A tensioning member 71 is couplable to the retaining member 70 for selectively securing the width adjustment portion 66 to the lever portion 60.

While the first extent 67 of the width adjustment portion 66 can function well having a variety of lengths, most preferably, it has a length approximately ⅛ of an inch less than said second extent 62 of the lever portion 60. This feature allows the top edge of the first extent 67 of the width adjustment portion 66 to strike the underside of the first extent 61 of the lever portion 60 when the device on under tension. This contact transfers sufficient force to inhibit the bending of the second extent 68 of the width adjustment portion 66 under tension when the width adjustment portion 66 is positioned proximal to the first jaw assembly 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool holding system for selectively retaining a tool by clamping a portion of the tool, the system comprising:

a mounting assembly for selectively coupling to a vertical surface of a structure;

a first jaw assembly operationally coupled to said mounting assembly, said first jaw assembly being adapted for abutting a first side of the portion of the tool being retained; and a second jaw assembly for abutting a second side of the portion of the tool being retained to selectively retain the portion between said first jaw assembly and said second jaw assembly, said second jaw assembly being pivotally coupled to said mounting assembly for permitting said second jaw assembly to pivot toward said first jaw assembly in a retaining position and away from said first jaw assembly in a release position;

wherein said first jaw assembly has a first abutting surface and said second jaw assembly has a second abutting surface, said first abutting surface and said second abutting surface abutting the portion of the tool when said second jaw assembly is in the retaining position;

wherein a position of the second abutting surface on said second jaw assembly is adjustable between a plurality of positions in a manner such that an angle between said first abutting surface and said second abutting surface is uniform at each of said plurality of positions of said second abutting surface;

wherein said second jaw assembly includes a coupling portion and a width adjustment portion, said width adjustment portion being slidably mounted on said coupling portion to move said second abutting surface toward said first abutting surface of said first jaw assembly.

2. The system of claim 1, wherein said mounting assembly further comprises:

a first mounting member having a first flange portion and a first horizontal support portion, said first flange portion being for abutting the vertical surface of the structure, said first horizontal support portion being coupled to said first flange portion, said first flange portion having a top surface defining a plane, said first horizontal support portion having a first surface defining a first vertical plane, said first horizontal portion being positioned such that said first vertical plane being substantially perpendicular to said plane formed by said top surface; and a second mounting member having a second flange portion and a second horizontal support portion, said second flange portion being for abutting the vertical surface of the structure, said second horizontal support portion being coupled to said second flange portion, said second flange portion having a second top surface defining a second plane, said second horizontal support portion having a second surface defining a second vertical plane, said second horizontal portion being positioned such that said second vertical plane being substantially perpendicular to said second plane formed by said second top surface.

3. The system of claim 1, wherein said first jaw assembly includes a pair of first abutting surfaces, said pair of abutting surfaces converging toward each other in a substantially upward direction when said mounting assembly is mounted on the structure, and diverging away from each other in a substantially downward direction when said mounting assembly is mounted on the structure.

4. The system of claim 2, further comprising:

said first horizontal support portion having a proximal end and a distal end, said proximal end being adjacent to said first flange portion, said distal end being adjacent to said first jaw assembly, said first horizontal support portion having a taper extending from a medial portion towards said distal end, said distal end having a width less than a width associated with said medial portion, said taper permitting pivoting of said second jaw 8 assembly with respect to said mounting assembly; and said second horizontal support portion having a proximal end and a distal end, said proximal end being adjacent to said second flange portion, said distal end being adjacent to said first jaw assembly, said second horizontal support portion having a taper extending from a medial portion towards said distal end, said distal end having a width less than a width associated with said medial portion, said taper permitting pivoting of said second jaw assembly with respect to said mounting assembly.

5. The system of claim 2, wherein said first horizontal support portion having a forward edge and a rearward edge, said forward edge being proximal to said first jaw assembly, said rearward edge being opposite said forward edge, said first horizontal support portion having a bottom edge, said bottom edge having a notch positioned therein adjacent to said forward edge, said notch having a vertical portion, said vertical portion being positioned in said first horizontal support portion at an angle.

6. The system of claim 2, further comprising:

wherein said first horizontal support portion having a forward edge and a rearward edge, said forward edge being proximal to said first jaw assembly, said rearward edge being opposite said forward edge, said first horizontal support portion having a bottom edge, said top bottom edge having a notch positioned therein adjacent to said forward edge, said notch having a vertical portion, said vertical portion being positioned in said first horizontal support portion at an angle; and wherein said second horizontal support portion having a second forward edge and a second rearward edge, said second forward edge being proximal to said first jaw assembly, said second rearward edge being opposite said second forward edge, said second horizontal support portion having a second bottom edge, said second bottom edge having a second notch positioned therein adjacent to said second forward edge, said second notch having a second vertical portion, said second vertical portion being positioned in said second horizontal support portion at an angle.

7. The system of claim 1, wherein an orientation of said second abutting surface at each of said plurality of positions is parallel to other of said plurality of positions.

8. The system of claim 1, wherein said mounting assembly has an angular notch receiving said first jaw assembly to increase a surface area of contact between said mounting assembly and said first jaw assembly to strengthen a union of said mounting assembly and said first jaw assembly.

9. The system of claim 3, wherein said pair of abutting surfaces are oriented substantially perpendicular to each other.

10. A tool holding system for selectively retaining a tool by clamping a handle of the tool, the system comprising:

a mounting assembly for selectively coupling said system to a vertical surface of a structure;

a first jaw assembly operationally coupled to said mounting assembly, said first jaw assembly being adapted for abutting a first side of the handle of the tool being retained;

a second jaw assembly pivotally coupled to said mounting assembly, said second jaw assembly being adapted for abutting a second side of the handle of the tool being retained, the handle being selectively retained between said first jaw assembly and said second jaw assembly;

wherein said mounting assembly further comprises:

a first mounting member having a first flange portion and a first horizontal support portion, said first flange portion being for abutting the vertical surface of the structure, said first horizontal support portion being coupled to said first flange portion, said first flange portion having a top surface defining a plane, said first horizontal support portion having a first surface defining a first vertical plane, said first horizontal portion being positioned such that said first vertical plane being substantially perpendicular to said plane formed by said top surface;

a second mounting member having a second flange portion and a second horizontal support portion, said second flange portion being for abutting the vertical surface of the structure, said second horizontal support portion being coupled to said second flange portion, said second flange portion having a second top surface defining a second plane, said second horizontal support portion having a second surface defining a second vertical plane, said second horizontal portion being positioned such that said second vertical plane being substantially perpendicular to said second plane formed by said second top surface;

said first flange portion having an aperture extending therethrough, said aperture facilitating coupling of said first flange portion to the surface of the structure;

said second flange portion having a second aperture extending therethrough, said second aperture facilitating coupling said second flange portion to the surface of the structure;

said first horizontal support portion having a proximal end and a distal end, said proximal end being adjacent to said first flange portion, said distal end being adjacent to said first jaw assembly, said first horizontal support portion having a taper extending from a medial portion towards said distal end, said distal end having a width less than a width associated with said medial portion, said taper permitting pivoting of said second jaw assembly with respect to said mounting assembly;

said second horizontal support portion having a proximal end and a distal end, said proximal end being adjacent to said second flange portion, said distal end being adjacent to said first jaw assembly, said second horizontal support portion having a taper extending from a medial portion towards said distal end, said distal end having a width less than a width associated with said medial portion, said taper permitting pivoting of said second jaw assembly with respect to said mounting assembly;

wherein said first jaw assembly further comprises a horizontal portion and a vertical portion, said horizontal portion being operationally coupled to said mounting assembly, said vertical portion being operationally coupled to said horizontal portion, said horizontal and vertical portions being for abutting the handle to the tool being retained;

wherein said second jaw assembly further comprises:

a coupling portion pivotally couplable to said mounting assembly;

a lever portion coupled to said coupling portion, said lever portion extending downwardly form said coupling portion, said lever portion providing a clamping force for retaining the handle of the tool;

a width adjustment portion slidably coupled to said lever portion, said width adjustment portion facilitating adjustment of said second jaw assembly to accommodate a diameter of the handle of the tool being retained; and a retaining assembly for slideably coupling said width adjustment portion to said lever portion.

11. The system of claim 10, wherein said coupling portion further comprises:

a horizontal member extending between said first support portion and said second support portion;

a first tab portion extending rearwardly from said horizontal member adjacent to said first support portion, said first tab portion facilitating pivotal coupling of said second jaw assembly to said mounting assembly; and a second tab portion extending rearwardly from said horizontal member adjacent to said second support portion, said second tab portion facilitating pivotal coupling of said second jaw assembly to said mounting assembly.

12. The system of claim 11, further comprising:

a first coupling hole extending through said first support portion;

a second coupling hole extending through said first tab portion, said second coupling hole being aligned with said first coupling hole;

a coupling means positioned through said first coupling hole and said second coupling hole, said coupling means permitting pivotal movement of said second jaw assembly with respect to said mounting assembly;

a third coupling hole extending through said second support portion;

a fourth coupling hole extending through said second tab portion, said fourth coupling hole being aligned with said third coupling hole;

a second coupling means positioned through said third coupling hole and said fourth coupling hole, said second coupling means permitting pivotal movement of said second jaw assembly with respect to said mounting assembly.

13. The system of claim 12, wherein said first coupling means and said second coupling means further comprise a single bolt extending through said first, second, third and fourth coupling holes, said bolt being secured with an associated nut.

14. The system of claim 12, wherein said first coupling means and said second coupling means further comprises a single pin extending through said first, second, third, and fourth coupling holes, said pin being secured with a cotter pin.

15. The system of claim 12, wherein said first coupling means and said second coupling means further comprises a single pin extending through said first, second, third, and fourth coupling holes, said pin being secured with a grip ring.

16. The system of claim 12, wherein said second hole being offset from a center of said first tab portion and said fourth hole being offset from a center of said second tab portion.

17. The system of claim 12, further comprising at least one biasing member coupled between said second jaw assembly and said mounting assembly, said biasing member urging said second jaw member towards a closed portion whereby the handle of the tool is retained.

18. The system of claim 12, further comprising a pair of biasing members, each one of said biasing members being operationally coupled between said second jaw assembly and said mounting assembly, each one of said pair of biasing members urging said second jaw member towards a closed portion whereby the handle of the tool is retained.

19. The system of claim 12, further comprising a first, second and third biasing member, each one of said first, second, and third biasing members being operationally coupled between said second jaw assembly and said mounting assembly, each one of said first, second, and third biasing members urging said second jaw member towards a closed portion whereby the handle of the tool is retained.

20. The system of claim 19, further comprising:

said first biasing member being a spring having seven coils, said first biasing member being adjacent to said first horizontal support portion;

said second biasing member being a spring having seven coils, said second biasing member being adjacent to said second horizontal support portion; and said third biasing member being a spring having five coils, said third biasing member being positioned between said first biasing member and said second biasing member.

21. The system of claim 10, further comprising:

wherein said coupling portion further comprises:

a horizontal member extending between said first support portion and said second support portion;

a first tab portion extending rearwardly from said horizontal member adjacent to said first support portion, said first tab portion facilitating pivotal coupling of said second jaw assembly to said mounting assembly;

a second tab portion extending rearwardly from said horizontal member adjacent to said second support portion, said second tab portion facilitating pivotal coupling of said second jaw assembly to said mounting assembly;

a first coupling hole extending through said first support portion;

a second coupling hole extending through said first tab portion, said second coupling hole being aligned with said first coupling hole;

a third coupling hole extending through said second support portion;

a fourth coupling hole extending through said second tab portion, said fourth coupling hole being aligned with said third coupling hole;

a single bolt extending through said first, second, third and fourth coupling holes, said bolt being secured with an associated nut; and a pair of biasing members, each one of said biasing members being operationally coupled between said second jaw assembly and said mounting assembly, each one of said pair of biasing members urging said second jaw member towards a closed portion whereby the handle of the tool is retained.

22. The system of claim 21, wherein each one of said first and second tab portions further comprise a tapered edge extending along said first jaw assembly said tapered edge abutting said first jaw assembly when said second jaw assembly is pivoted to a maximum open portion, said tapered edge being a stop for said second jaw assembly.

23. The system of claim 10, wherein said lever portion further comprises:

a first extent coupled to said coupling portion, said first extent extending downwardly from said coupling portion, said first extent defining a maximum width between said first jaw assembly and said second jaw assembly;

a second extent having an angular relationship to said first extent, said second extent being coupled to said first extent; and a third extent extending downwardly from said second extent, said third extent abutting the surface of the structure when said second jaw assembly is in a closed portion, said third extent providing a handle to be grasped by the user to facilitate removal of the tool being retained from the system.

24. The system of claim 23, wherein said first extent tapers inwardly as it extends away from said coupling portion towards said second extent, said first extent having a first width adjacent to said coupling portion, said first extent having a second width adjacent to said second extent, said first width being greater than said second width.

25. The system of claim 23, wherein said width adjustment portion further comprises:

a first retaining extent being substantially parallel to said second extent of said lever portion; and a second retaining extent being substantially parallel to said third extent of said lever portion, said second retaining extent being slidable along said third extent whereby a width of said second jaw assembly is adjustable.

26. The system of claim 25, further comprising:

a lever aperture extending through said third extent of said lever portion;

a slot extending along a longitudinal axis of said second retaining extent;

a retaining member extending through said slot and said lever aperture; and a tensioning member couplable to said retaining member for selectively securing said width adjustment portion to said lever portion.

27. The system of claim 10, further comprising:

wherein said lever portion further comprises:

a first extent coupled to said coupling portion, said first extent extending downwardly from said coupling portion, said first extent defining a maximum width between said first jaw assembly and said second jaw assembly;

a second extent having an angular relationship to said first extent, said second extent being coupled to said first extent;

a third extent extending downwardly from said second extent, said third extent abutting the surface of the structure when said second jaw assembly is in a closed portion, said third extent providing a handle to be grasped by the user to facilitate removal of the tool being retained from the system;

wherein said width adjustment portion further comprises:

a first retaining extent being substantially parallel to said second extent of said lever portion;

a second retaining extent being substantially parallel to said third extent of said lever portion, said second retaining extent being slidable along said third extent whereby a width of said second jaw assembly is adjustable;

a lever aperture extending through said third extent of said lever portion;

a slot extending along a longitudinal axis of said second retaining extent;

a retaining member extending through said slot and said lever aperture; and a tensioning member couplable to said retaining member for selectively securing said width adjustment portion to said lever portion.

28. The system of claim 10, further comprising:

wherein said coupling portion further comprises:

a horizontal member extending between said first support portion and said second support portion;

a first tab portion extending rearwardly from said horizontal member adjacent to said first support portion, said first tab portion facilitating pivotal coupling of said second jaw assembly to said mounting assembly;

a second tab portion extending rearwardly from said horizontal member adjacent to said second support portion, said second tab portion facilitating pivotal coupling of said second jaw assembly to said mounting assembly;

a first coupling hole extending through said first support portion;

a second coupling hole extending through said first tab portion, said second coupling hole being aligned with said first coupling hole;

a third coupling hole extending through said second support portion;

a fourth coupling hole extending through said second tab portion, said fourth coupling hole being aligned with said third coupling hole;

a single bolt extending through said first, second, third and fourth coupling holes, said bolt being secured with an associated nut;

a pair of biasing members, each one of said biasing members being operationally coupled between said second jaw assembly and said mounting assembly, each one of said pair of biasing members urging said second jaw member towards a closed portion whereby the handle of the tool is retained;

wherein each one of said first and second tab portions further comprise a tapered edge extending along said first jaw assembly said tapered edge abutting said first jaw assembly when said second jaw assembly is pivoted to a maximum open portion, said tapered edge being a stop for said second jaw assembly;

wherein said lever portion further comprises:

a first extent coupled to said coupling portion, said first extent extending downwardly from said coupling portion, said first extent defining a maximum width between said first jaw assembly and said retaining member of said second jaw assembly;

a second extent having an angular relationship to said first extent, said second extent being coupled to said first extent;

a third extent extending downwardly from said second extent, said third extent abutting the surface of the structure when said second jaw assembly is in a closed portion, said third extent providing a handle to be grasped by the user to facilitate removal of the tool being retained from the system;

wherein said width adjustment portion further comprises:

a first retaining extent being substantially parallel to said second extent of said lever portion;

a second retaining extent being substantially parallel to said third extent of said lever portion, said second retaining extent being slidable along said third extent whereby a width of said second jaw assembly is adjustable;

a lever aperture extending through said third extent of said lever portion;

a slot extending along a longitudinal axis of said second retaining extent;

a retaining member extending through said slot and said lever aperture; and a tensioning member couplable to said retaining member for selectively securing said width adjustment portion to said lever portion.

* * * * *